US008696177B1

(12) United States Patent
Frost

(10) Patent No.: US 8,696,177 B1
(45) Date of Patent: Apr. 15, 2014

(54) WORKSHOP ACCESSORY

(76) Inventor: Timothy Lee Frost, Chattanooga, TN (US)

( * ) Notice: Subject to any disclaimer, the term of this patent is extended or adjusted under 35 U.S.C. 154(b) by 94 days.

(21) Appl. No.: 13/188,552

(22) Filed: Jul. 22, 2011

Related U.S. Application Data

(60) Provisional application No. 61/366,958, filed on Jul. 23, 2010.

(51) Int. Cl.
*F21V 21/00* (2006.01)

(52) U.S. Cl.
USPC ..... 362/382; 362/418; 362/287

(58) Field of Classification Search
USPC ..... 362/418, 419, 427, 287, 401, 413; 248/122, 278
See application file for complete search history.

(56) References Cited

U.S. PATENT DOCUMENTS

| | | | | | |
|---|---|---|---|---|---|
| 5,126,928 | A * | 6/1992 | Hughes | ..... | 362/287 |
| 5,386,358 | A * | 1/1995 | Hillinger | ..... | 362/431 |
| 5,424,931 | A * | 6/1995 | Wheeler | ..... | 362/418 |
| 6,139,164 | A * | 10/2000 | Bolta et al. | ..... | 362/217.1 |
| 8,322,877 | B1 * | 12/2012 | Merritt | ..... | 362/220 |

* cited by examiner

*Primary Examiner* — Ali Alavi
(74) *Attorney, Agent, or Firm* — Stephen J. Stark; Miller & Martin PLLC

(57) ABSTRACT

A garage or work shop utility device provides a mobile base with wheels and a vertical support structure that can accept numerous attachments designed to aid in the performance of garage or work shop tasks.

18 Claims, 7 Drawing Sheets

WORKSHOP ACCESSORY

CLAIM OF PRIORITY

This application claims the benefit of U.S. Provisional Patent Application No. 61/366,958 filed Jul. 23, 2010.

FIELD OF THE INVENTION

The present invention relates to a workshop accessory, and more particularly, to a mobile and/or adjustable workshop device with multiple attachments which can be utilized at least in some embodiments to provide lighting, additional power outlets, bucket storage, an adjustable tray, a vacuum cleaner attachment and combinations of these features possibly together with a storage system.

BACKGROUND OF THE INVENTION

In a garage or work shop environment there exists a need for a new device that may be able to aid in the completion of several tasks.

In a work shop environment, it is often useful, if not critical, to have sufficient lighting in the area where the work is to be performed. Overhead lighting is rarely sufficient for detailed work due to the distance from the light source to the work area and also due to shadowing caused by objects between the light source and the work area. Lights with hooks, clamps, etc., are not sufficient in many cases because there is no convenient location to hook or clamp the light.

When performing tasks in a work shop environment, there is also often a shortage of available electrical outlets to supply the electricity for the multiple power tools required. There are many products currently available to provide additional electrical outlets, but these inventions typically do not provide for the convenient positioning of the additional outlets in the area where the work is being performed.

In many instances in a work shop environment, there is also a lack of sufficient space to temporarily store tools and parts. For instance, when working on an automobile engine, there typically is not satisfactory location to place tools and parts in a convenient location while they are not in use.

When washing an automobile, motorcycle or any other object or device using a wash bucket, it is often difficult to maneuver the wash bucket full of soap and water to a position that is convenient to the area that is being washed. This maneuvering of the bucket is most often performed by lifting the bucket filled with soap and water and carrying it to the desired location. There are some inventions that provide for a wheeled dolly or base for the bucket that allow the user to simply roll the bucket to the desired location. However, these inventions still require the user to bend over to maneuver the bucket and they do not typically provide for the temporary storage or placement of other tools that may be used periodically during the washing procedure.

It is also very common in a garage or work shop environment to utilize a vacuum cleaner to remove debris. There are numerous configurations of vacuum cleaners used in the work shop environment. However, there is a need for a vacuum cleaner configuration that is maneuverable relative to its horizontal location and has the ability to be positioned in any desired vertical location without the requirement for the operator to hold the vacuum assembly in his or her hand.

There exists a need to overcome at least one of these perceived prior art deficiencies.

SUMMARY OF THE INVENTION

It is an object of many embodiments of the present invention to provide a mobile and adjustable light source for performing garage or work shop tasks.

It is an object of many embodiments of the present invention to provide multiple electrical outlets that can be positioned in convenient location for powering multiple electrical devices used in a garage or work shop environment.

It is an object of many embodiments of the present invention to provide a mobile and adjustable device that provides for the temporary storage of tools and or spare parts in a convenient location while performing tasks in a garage or work shop environment.

It is an object of many embodiments of the present invention to provide a mobile device for positioning and maneuvering a wash bucket conveniently in the process of washing a vehicle or other item.

It is an object of many embodiments of the present invention to provide a mobile and adjustable device that allows for the convenient location and maneuvering of a vacuum cleaner in a garage or work shop environment.

It is an object of many embodiments of the present invention to provide a mobile and adjustable device that allows for the attachment of multiple devices used in a garage or work shop environment. These devices may be attached to the mobile and adjustable device individually or in combinations to suit the garage or work shop task being performed.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
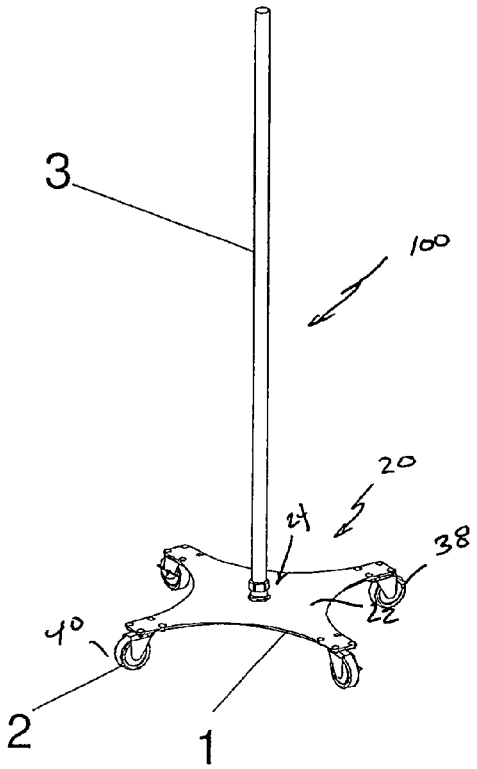
FIG. 1 is a front perspective view of the first preferred embodiment of a base assembly.
Figure 2:
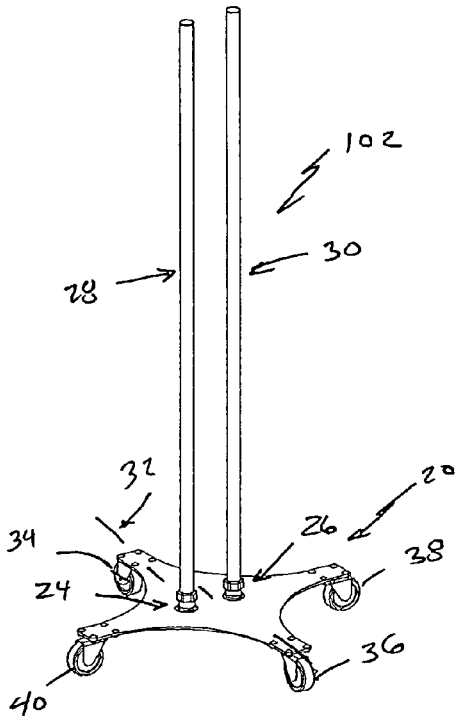
FIG. 2 is a front perspective view of a first alternatively preferred embodiment of the base assembly similar to FIG. 1 showing two support members extending from the base.

FIG. 1 is a perspective view of a first preferred embodiment of a base member 20. Base assembly 20 has an upper surface 22 to which a connector 24 connects. In FIG. 2, connector 24 is the first connector which is shown spaced apart from the second connector 26. In this embodiment, first and second vertical support members 28,30 are provided such as could possibly be done to symmetrically relative to base 20 such as to first and second connectors 24,26 or symmetrically disposed relative to base 20 such as relative to a center line 32 extending between first and second wheels 34,36 with third and fourth wheels 38,40 also being shown in this figure. Many of the same components are shown in FIGS. 1 and 2 except that first and second connectors 24,26 are symmetrically disposed relative to the center line 32. Other arrangements for connector(s) 24 and 26. Connector 24,26 may or may not allow for rotation of the vertical support members 28,30 relative to base member 20 once installed.

The first, second, third and fourth wheels 34,36,38,40 downwardly extend relative to the base 20 or from a bottom side thereof. First, second, third and fourth wheels 34,36,38, 40 are show as roller wheels that could be caster, roller wheels, locking or otherwise, or other wheels such as those illustrated. Wheels 34,36,38,40 are shown attached to the base member and downwardly extending therefrom providing mobility for the workshop device 100 and/or 102. Other numbers of wheels could be provided with other embodiments. Wheels 34,36,38,40 connect to base member 20 such as with connectors like nuts and bolts as shown or otherwise. Although for wheels 34,36,38,40 are shown, any number of wheels could be utilized in various embodiments. Wheels 34,36,38,40 are shown cantileveredly extending on arms 35,37,39,41, but could otherwise be supplied by base 20.

FIG. 2 is a perspective view of a first alternatively preferred embodiment of the base assembly similar to FIG. 1.

Wheels 34,36,38,40 define a perimeter that is a sufficient distance from vertical support member(s) 28,30 so that when attachments connect to the vertical support member(s) 28,30, their center of gravity remains internal to the perimeter of the wheels 34,36,38, and/or 40 to prevent tipping over.

Figure 3:
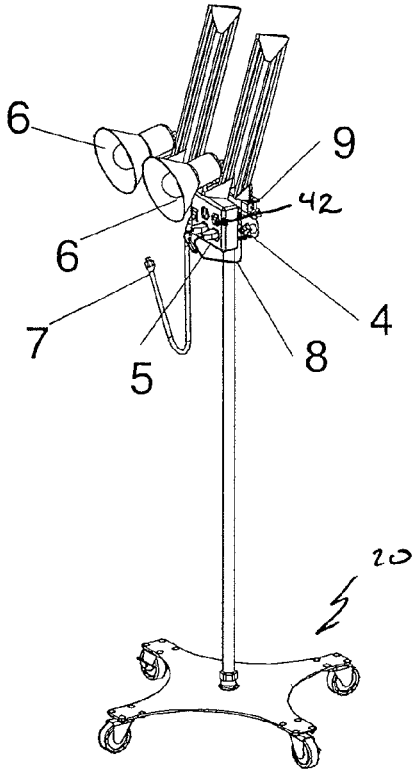
FIG. 3 is a front perspective view of an embodiment showing the base assembly of FIG. 1 with a carrier assembly supporting two lights.

FIG. 3 is a perspective view of the workshop device 100 with a base 20, multiple wheels 34,36,38,40 and a vertical support member 3. Attached to the vertical support member 3 is a carrier assembly 9. The carrier assembly 9 can preferably be moved vertically along at least a substantial, if not virtually the entire length of the vertical support member 3 for at least some embodiments and preferably secured at desired vertical positions such as by tightening of the clamping mechanism 4 as will be explained in detail below.

Attached to the carrier assembly 9 are illustrated two lights 6 that may be adjusted to allow the illumination of the desired work space. This figure shows two lights 6, but it will be easily understood that the carrier assembly 9 could be fitted with more or less lights 6 as desired. Also attached to the carrier device is an electrical outlet box 5. This electrical outlet box 5 preferably provides an electrical supply cord 7 and possibly can receive one or multiple electrical cord(s) 8 and/or can also provide outlets 42 to power the lights 6 as well as other electrical devices that may be used in the garage or work shop environment.

Figure 4:
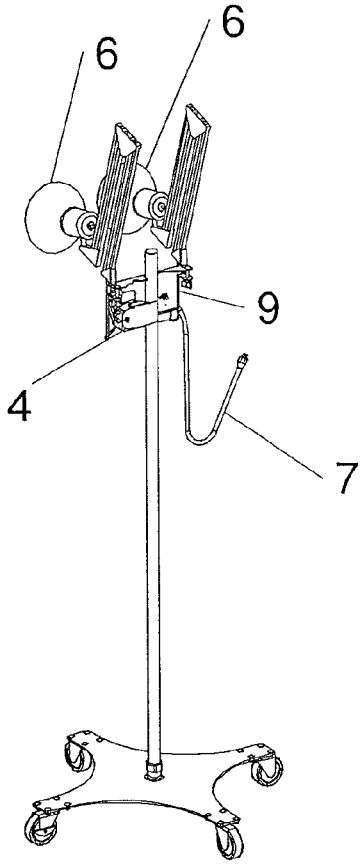
FIG. 4 is a rear perspective view of the base and lights of embodiment of FIG. 3.

FIG. 4 is a rear perspective view showing the base 20, multiple wheels 34,36,38,40, vertical support member 3, carrier assembly 9 with clamping mechanism 4, electrical outlet box 5, lights 6 and electrical outlet box power supply cord 7.

Figure 5:
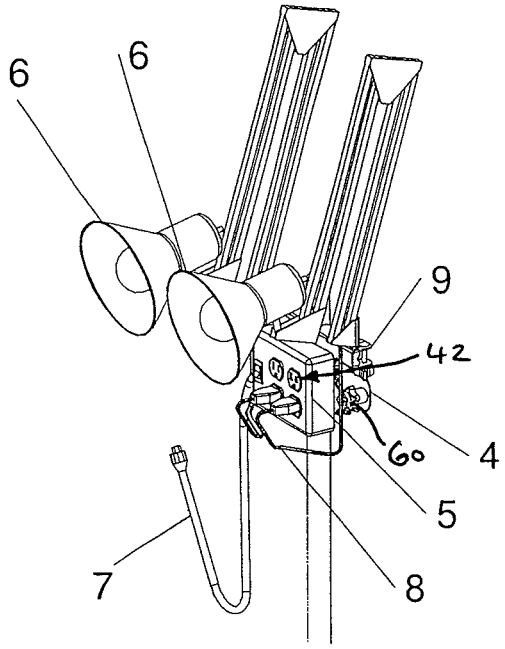
FIG. 5 is a close-up front perspective view of an upper portion of the vertical support member and carrier assembly as well as electrical box and lights of FIGS. 3 and 4.
Figure 6:
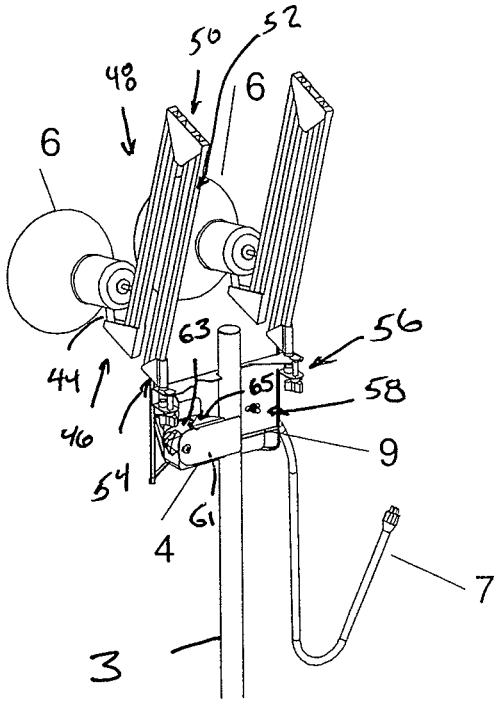
FIG. 6 is a rear perspective view showing the detail of FIG. 5.

FIGS. 5 and 6 provide a close up view of the vertical support member 3, carrier assembly 9 with clamping mechanism 4, electrical outlet box 5, lights 6 electrical outlet box power supply cord 7 and light electrical power cords 8. As one can see with reference to FIGS. 4-6, the lights 6 can take various forms. This light 6 has rotating arm segments such as rotating arm 44 shown connected to the pivot member 46. A linking arm 48 then connects to another pivot member 50 which connects to a linking arm 52 which connects to rotating base 54 which can be rotatable relative to carrier assembly 9, as illustrated. The lights 6 may be adjustably positionable relative to the clamping mechanism 4 and/or carrier assembly 9. Clamp 56 may be useful to secure the light 6 to the carrier member 9.

Outlets 42 may be supported in an outlet box 5 which is shown in FIG. 6 connected to the carrier assembly 9 such as by screws, i.e., connector 58. The clamping mechanism 4 is also shown connected to the carrier assembly 9 and this may be a screw connection or otherwise. Other connection systems include CAM action locks or other locking or securing systems as would be known by those of ordinary skill in the art. Twisting of knob 60 may effectuate the lock of the clamping mechanism 4 in FIGS. 3-6. Other mechanism may be utilized with other embodiments. Accordingly, by either screwing or unscrewing the wheel or knob 60, the clamping mechanism 4 is either tightened or loosened by allowing the elevational positioning of the carrier assembly 9 relative to what elevation is relative to the vertical support member 3. Movement of knob moves first arm 61 relative to second arm 63 about pivot 65 to thereby increase or decrease the grip of the arms opposite the pivot 65 from the knob 60. Other mechanisms may operate differently. Carrier assembly 9 bolts or is otherwise connected to clamping mechanism 4.

Figure 7:
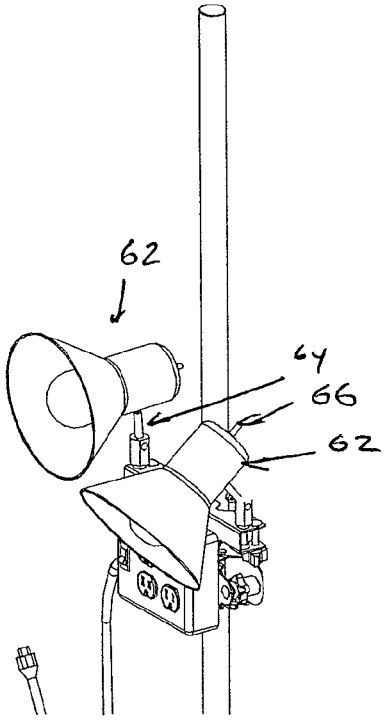
FIG. 7 is a front perspective view of a first alternatively preferred embodiment of the carrier assembly of FIG. 1 with an alternatively preferred embodiment of the lights connected to the outlet box.

FIG. 7 provides views of alternate embodiments of the lights 62 connected to carrier assembly 9. Lights 62 may be positionable along a number of axes such as rotation about arm 64 and/or pivotable such as downwardly as is shown with the right hand light 62 and/or as compared to the left hand light 62. On/off switches such as push on switch 66, may be useful to turn off all lights 62. Lights 62 may plug into outlets 42 in the electrical outlet box 5.

Figure 8:
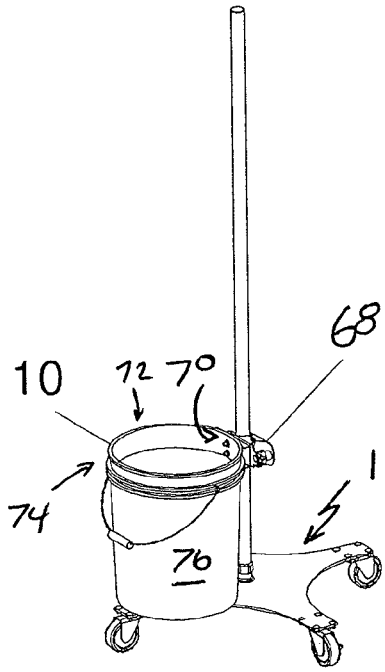
FIG. 8 is a front perspective view of the base of FIG. 1 as a second alternatively preferred embodiment with a bucket and clamping mechanism.

FIG. 8 is a perspective view of the base assembly including a base 1, multiple wheels 2 and a vertical support member 3 along with a wash bucket 10 and clamping mechanism 68 attached to the vertical support member 3 and supported by the base 1. Clamping assembly 68 may be similar or dissimilar to clamping assembly 4 but preferably has connectors 70 which connect to the bucket 10. Connectors 70 are shown connecting to the upper portion such as rim near 72 such as above a satellite ring 74 but could also be provided on side wall 76 in other embodiments. The bucket 10 may rest on the base 20 as illustrated.

Figure 9:
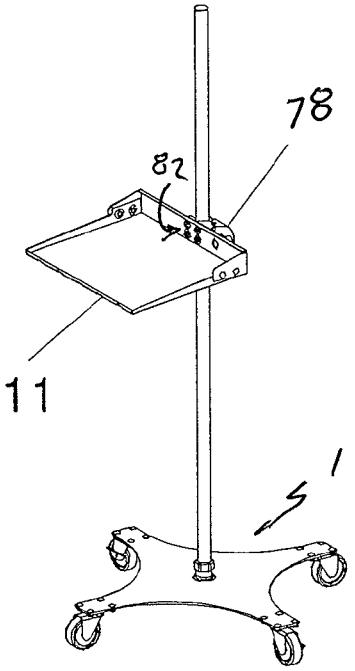
FIG. 9 is a front perspective view of the base assembly of FIG. 1 as a third alternatively preferred embodiment to go with the tray assembly and clamping mechanism.

FIG. 9 is a perspective view of the workshop device 100 including a base 1, multiple wheels 2 and a vertical support member 3 along with a tool or parts storage tray 11 and clamping mechanism 78 attached to the vertical support member 3. FIG. 9 shows a clamping member 78 connected to a tray 11 such as with connectors 82. The tray 11 is illustrated cantileveredly supported relative to the connector mechanism 78 and is elevationally positionable relative to the vertical support member 3. Connector mechanism 78 may be similar to clamping mechanism 4 as illustrated or different.

Figure 10:
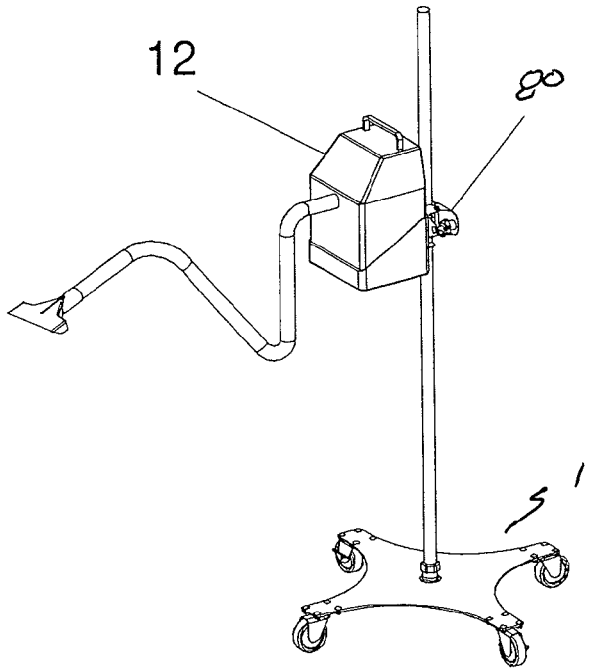
FIG. 10 is a front perspective view of a base assembly of FIG. 1 as a fourth preferred embodiment showing the base connected to the vacuum and a clamping mechanism.

FIG. 10 is a perspective view of the base assembly including a base 1, multiple wheels 2 and a vertical support member 3 along with a vacuum cleaner 12 and clamping mechanism 80 attached to the vertical support member. The vacuum cleaner 12 can be advantageously elevationally positioned while still providing mobility. Clamping mechanism 80 may be similar to or dissimilar to clamping member 4.

Figure 11:
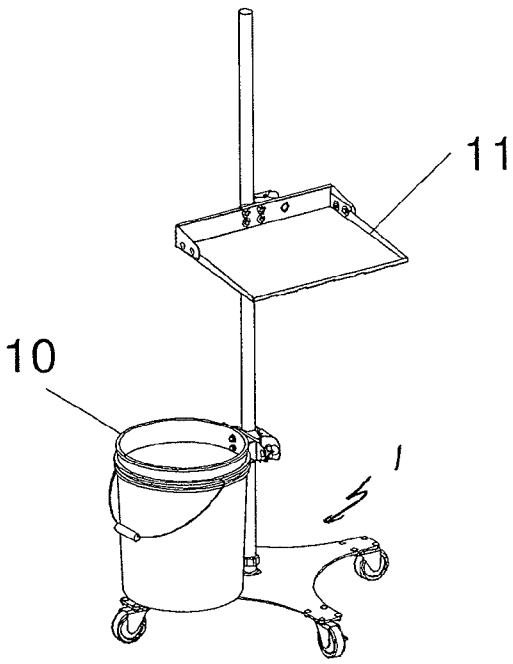
FIG. 11 is a front perspective view showing the storage tray of FIG. 9 and bucket of FIG. 8 that goes with clamping mechanisms connected to the base assembly.

FIG. 11 is a perspective view of the workshop device 100 including a base 1, multiple wheels 2 and a vertical support member 3 along with wash bucket 10 and tool or parts storage tray 11 attached to the vertical support member 3. This figure illustrates that multiple attachments may be attached to the base assembly simultaneously.

Figure 12:
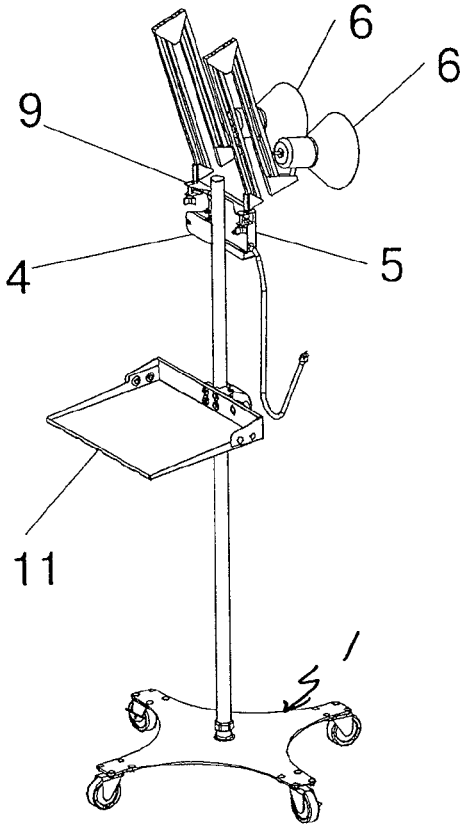
FIG. 12 is a front perspective view showing the base assembly connected to a tray as in FIG. 1 and lights as well as an electrical boxes shown in FIGS. 3-6.

FIG. 12 is a perspective view of the base assembly including a base 1, multiple wheels 2 and a vertical support member 3 along with tool or parts storage tray 11, carrier assembly 9, electrical outlet box 5 and lights 6 attached to the vertical support member. This figure also illustrates that multiple attachments may be attached to the base assembly simultaneously.

Figure 13:
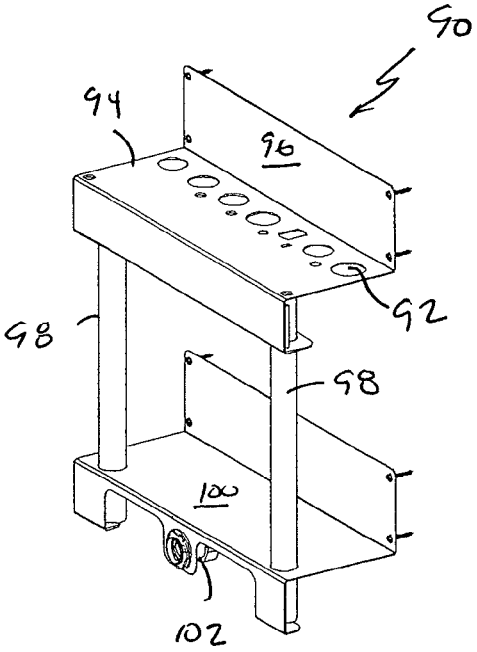
FIG. 13 is a front perspective view of a wall storage device with attachments removed for use with the various attachments.

FIG. 13 is a perspective view of the wall storage device 90 for storage of the multiple attachments when they are not attached to the base assembly. The storage device 90 may have plurality of openings 92 which cooperate with various components such as the hose members from the vacuum cleaner 12 and/or attachments or other features. The openings can be supported by a shelf member 94 which can be connected to a vertical member 96 which can connect to a vertical wall such as garage wall or otherwise. Piers 98 may be useful to downwardly extend to a shelf 100 onto which the components could be connected or supported on for storage such as the tray 11 connecting to the extension 102 and the connector 70 of the bucket 10 and the connector 80 of the vacuum cleaner 12 connecting to the piers 98 for storage therefore leaving the shelf 100 available for such things as electrical cords, washing brushes or cleaning agents, etc.

Figure 14:
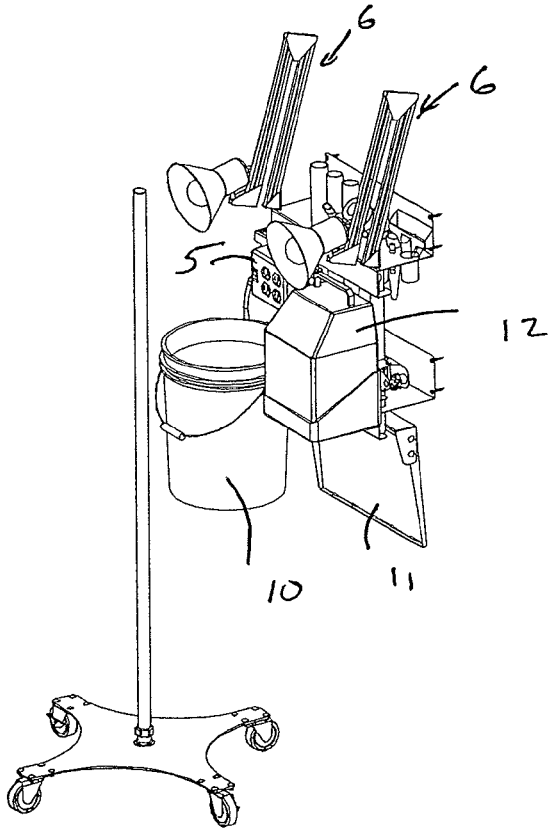
FIG. 14 is a front perspective view showing the wall storage device with multiple attachments stored thereon.

FIG. 14 is a perspective view of the wall storage device with the multiple attachments stored on the wall storage device.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

I claim:

1. A mobile and adjustable work shop device comprising:
a base member;
multiple wheels attached to the base member and downwardly extending therefrom for mobility;
at least one vertical support member attached to the base extending upwardly relative to the base;
a carrier assembly that can be configured to be moved along at least a substantial height of at least one of the vertical support members and secured at a desired vertical position on the vertical support member;
at least one light attached to the carrier assembly;
an electrical outlet box with an electrical supply cord and multiple electrical supply outlets attached to the carrier assembly as supported by the vertical support member; and
a vacuum cleaner assembly connected to a clamping mechanism, said clamping mechanism movable vertically along at least a portion of the length of the vertical support member and secured at a selected elevation with the clamping mechanism, thereby supporting the vacuum cleaner at a desired elevation relative to the base member on the vertical support member.

2. The mobile and adjustable work shop device of claim 1 further comprising lights adjustably positionable relative to the carrier assembly when installed.

3. A mobile and adjustable work shop device of claim 2 wherein the lights are plugged into outlets in the electrical outlet box.

4. The mobile and adjustable work shop device of claim 1 further comprising a bucket with the bottom of the bucket resting on the base member and a clamping mechanism attached to the bucket above a bottom of the bucket with the clamping mechanism attached to the vertical support member.

5. The mobile and adjustable work shelf device of claim 1 further comprising a tray attached to the vertical support member via a clamping mechanism wherein the tray is adjustably positionable relative to the vertical support member elevationally and configured to be locked in place at a desired elevation with the clamping mechanism.

6. A mobile and adjustable work shop or garage device for providing maneuverability for a wash bucket comprising:
a base member;
multiple wheels attached to the base member providing mobility;
at least one or more vertical support members attached to the base;
a bucket connected to a clamping mechanism attached at an outer diameter of the bucket and providing selected attachment of the bucket to the vertical support member at a desired elevation on the vertical support member; and
a vacuum cleaner assembly with a clamping mechanism, said clamping mechanism movable vertically along at least a portion of the length of the vertical support member and secured at a desired elevation via the clamping mechanism whereby the vacuum is supported at a desired elevation relative to the base member on the vertical support member.

7. A mobile and adjustable work shop device comprising:
a base member;
multiple wheels attached to the base member and downwardly extending therefrom for mobility;
at least one vertical support member attached to the base extending upwardly relative to the base;
a carrier assembly that can be configured to be moved along at least a substantial height of at least one of the vertical support members and secured at a desired vertical position on the vertical support member;
at least one light attached to the carrier assembly; and
an electrical outlet box with an electrical supply cord and multiple electrical supply outlets attached to the carrier assembly as supported by the vertical support member; and
a wall storage device comprising one or more piers wherein attachments configured to be attachable to the vertical support member can be attached to the wall storage device when not in use on at least one pier.

8. The mobile and adjustable work shop device of claim 1 further comprising a clamping mechanism for selectively securing the carrier assembly at the desired vertical position.

9. The mobile and adjustable work shop device of claim 1 wherein the clamping mechanism provides two pivotably connected arms connected at a pivot and an adjustment mechanism wherein the adjustment mechanism pivots the arms relative to the pivot whereby movement of the adjustment mechanism opposite the pivot thereby causes the arms to move at least opposite the pivot from the adjustment mechanism relative to the vertical support member.

10. The mobile and adjustable work shop device of claim 1 wherein the wheels define a perimeter and the center of gravity of the work shop device loaded with at least one attachment is within the perimeter.

11. A mobile and adjustable work shop or garage device for providing maneuverability for a wash bucket comprising:

a base member;

multiple wheels attached to the base member providing mobility;

at least one or more vertical support members attached to the base;

a bucket connected to a clamping mechanism attached at an outer diameter of the bucket and providing selected attachment of the bucket to the vertical support member at a desired elevation on the vertical support member; and a wall storage device comprising one or more vertical support member wherein attachments normally configured to be attached to the vertical support member can be attached to a vertical support member of the wall storage device when not in use on the vertical support member of the work shop device.

12. The mobile and adjustable work shop device of claim 11 further comprising an electrical supply cord extending from the carrier assembly and multiple electrical supply outlets provided by the carrier assembly, and whereby the carrier assembly can be moved along at least a portion of the height of at least one of the vertical support members and secured at a desired vertical position on at least a portion of the electrical member by a clamping mechanism; and at least one of a light attached to the carrier assembly and an electrical box outlet with electrical supply cord and multiple electrical outlet supply outlets attached to the carrier assembly.

13. The mobile and adjustable work shop device of claim 11 further comprising:

a tray attached to the vertical support member with a clamping mechanism wherein the tray is adjustably positionable relative to the vertical support member elevationally and configured to be secured in place at a desired elevation.

14. The mobile and adjustable work shop device of claim 11 wherein the clamping mechanism provides two pivotably connected arms connected at a pivot and an adjustment mechanism wherein the adjustment mechanism pivots the arms relative to the pivot whereby movement of the adjustment mechanism opposite the pivot thereby causes the arms to move at least opposite the pivot from the adjustment mechanism relative to the vertical support member.

15. The mobile and adjustable work shop device of claim 11 wherein the wheels define a perimeter and the center of gravity of the work shop device loaded with at least one attachment is within the perimeter.

16. The mobile and adjustable work shop device of claim 11 further comprising lights adjustably positionable relative to the carrier assembly when installed.

17. The mobile and adjustable work shop device of claim 11 wherein the wheels define a parameter and the bucket when filled has a center of gravity located within the parameter of the wheels.

18. The mobile and adjustable work shop device of claim 11 wherein the base provides arms connected respectively to each of the wheels which extend cantileveredly away from the at least one vertical support members.

* * * * *